US008197283B2

(12) United States Patent
Radzik et al.

(10) Patent No.: US 8,197,283 B2
(45) Date of Patent: Jun. 12, 2012

(54) COAXIAL CABLE CONNECTOR WITH RFI SEALING

(75) Inventors: Jack Radzik, Trumansburg, NY (US); Charles Thomas, Athens, PA (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/231,151

(22) Filed: Sep. 13, 2011

(65) Prior Publication Data

US 2012/0064763 A1 Mar. 15, 2012

Related U.S. Application Data

(63) Continuation of application No. 12/754,874, filed on Apr. 6, 2010, now Pat. No. 7,033,862.

(60) Provisional application No. 61/166,956, filed on Apr. 6, 2009.

(51) Int. Cl.
*H01R 9/05* (2006.01)

(52) U.S. Cl. ..... 439/578

(58) Field of Classification Search ..... 439/578, 439/573, 675, 394
See application file for complete search history.

(56) References Cited

U.S. PATENT DOCUMENTS

| | | | |
|---|---|---|---|
| 4,408,822 | A | 10/1983 | Nikitas |
| 5,002,503 | A | 3/1991 | Campbell et al. |
| 5,186,655 | A | 2/1993 | Glenday et al. |
| 5,525,076 | A | 6/1996 | Down |
| 5,667,405 | A | 9/1997 | Holliday |
| 6,210,222 | B1 | 4/2001 | Langham et al. |
| 6,783,394 | B1 | 8/2004 | Holliday |
| 6,817,896 | B2 | 11/2004 | Derenthal |
| 6,830,479 | B2 | 12/2004 | Holliday |
| 7,097,499 | B1 | 8/2006 | Purdy |
| 7,128,603 | B2 | 10/2006 | Burris et al. |
| 7,264,502 | B2 | 9/2007 | Holland |
| 7,371,113 | B2 | 5/2008 | Burris et al. |
| 2002/0030329 | A1 | 3/2002 | Montena |
| 2007/0232088 | A1 | 10/2007 | Burris et al. |
| 2008/0102696 | A1 | 5/2008 | Montena |
| 2008/0248689 | A1 | 10/2008 | Montena |
| 2009/0258537 | A1 | 10/2009 | Malak |

OTHER PUBLICATIONS

European Search Report for Application No. 10159161, mail date Sep. 17, 2010, 10 pages.

*Primary Examiner* — Phuong Dinh
(74) *Attorney, Agent, or Firm* — Foley & Lardner LLP

(57) ABSTRACT

A coaxial cable connector and method that will direct the electromagnetic field carrying the electrical signal in a coaxial cable to the inner surface of a conductive layer of the foil of the cable, as opposed to the outer surface. With the electrical signals traveling on the inner surface of the foil conductive layer, the foil conductive layer serves as a contiguous gap-free shield to prevent the ingress and/or egress of RFI.

6 Claims, 11 Drawing Sheets

COAXIAL CABLE CONNECTOR WITH RFI SEALING

CROSS-REFERENCE TO RELATED PATENT APPLICATIONS

This application is a continuation of U.S. application Ser. No. 12/754,874, filed Apr. 6, 2010, which claims the benefit of U.S. Provisional Application No. 61/166,956, filed on Apr. 6, 2009, both of which are incorporated by reference herein in their entireties.

BACKGROUND

The present disclosure relates generally to connectors for terminating coaxial cable. More particularly, the present disclosure relates to a coaxial cable connector having improved radio frequency integrity (RFI) sealing.

It has long been known to use coaxial cable to carry communication signals from an external source to various electronic devices such as televisions, radios and the like. Conventional coaxial cables typically include a center conductor surrounded by an insulator. A conductive foil is disposed over the insulator and a braided conductive shield surrounds the foil covered insulator. An outer insulative jacket surrounds the shield.

It is also well known to use connectors to terminate coaxial cable so as to connect the cable to the various electronic devices. Prior art coaxial connectors generally include a connector body having an annular collar for accommodating the coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator.

Upon assembly, a coaxial cable is inserted into the cable receiving end of the connector body, wherein the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

The design objective of coaxial cables is to carry the electromagnetic field between the inner and outer conductor, while providing protection from external signal ingress, which may cause interference with the signal being transmitted. However, as community television (CATV) systems have become more sophisticated in carrying many more channels of analog and digital information, the problems of interference caused by the ingress of radio frequency (RF) signals have grown.

The conductive foil surrounding the center dielectric of newer coaxial cable designs include a layer of aluminum laminated on a layer of a polyester (PET) film (Mylar) tape. The foil is wrapped around the center dielectric with the Mylar layer making contact with the dielectric and with the aluminum layer forming the outer surface of the foil. Conventionally, the electrical signals will travel through the cable on the outer surface of the aluminum layer of the foil due to a phenomenon known in the field as the skin effect.

To shield the electrical signals traveling along the outer surface of the foil from RF interference, conventional coaxial cables typically include a conductive shield surrounding the foil. However, because the conductive shield surrounding the foil typically has a braided construction to provide flexibility to the cable, the electrical signals travelling on the outer surface of the foil are vulnerable to interference from RF energies due to the gaps in the shield resulting from the braided construction.

Some coaxial cable designs address this issue by providing an additional conductive foil layer to improve shielding. However, additional layers of foil also contribute to the cost of the cable. Moreover, while these newer conductive foil designs improve RF shielding to some extent, the present conventional coaxial cable connector interface designs do not provide reliable means to receive the energy from the foil layer.

Accordingly, it would be desirable to provide a coaxial cable connector that will provide improved RFI shielding. It would be further desirable to provide a coaxial cable connector with an improved RF interface that will maintain the signal propagating function of the cable throughout the coupling interface for full shielding benefits.

SUMMARY OF THE INVENTION

It is an object of the present disclosure to provide a coaxial cable connector for terminating a coaxial cable.

It is a further object of the present disclosure to provide a coaxial cable connector having structure to enhance RF coupling and sealing.

In the efficient attainment of these and other objects, the present invention provides a coaxial cable connector that will direct the electromagnetic field carrying the electrical signal to the inner surface of the conductive layer of the foil, as opposed to the outer surface. With the electrical signals traveling on the inner surface of the foil conductive layer, the foil conductive layer serves as a contiguous gap-free shield to prevent the ingress and/or egress of RFI.

To force the electrical signals to the inner surface of the foil conductive layer, in one embodiment, the connector of the present invention generally includes a connector body having a forward end and a rearward cable receiving end for receiving a cable, a post disposed in the forward end of the connector body and an annular signal ring disposed within a forward end of the post. The annular sealing ring engages the conductive layer of the foil, thereby delivering electrical signals to the inner surface of the foil conductive layer.

In a preferred embodiment, the signal ring includes a tubular body portion and a radially enlarged head portion, wherein the body portion preferably terminates at a sharp edge. The signal ring further preferably includes a tubular tensioning sleeve extending axially from the head portion in a forward direction opposite the tubular body portion. The tubular tensioning sleeve preferably includes at least one axial slot formed therein and a rounded forward end forming a bulbous rim.

In an alternative embodiment, the coaxial cable connector of the present invention includes a post having an inner surface designed to make electrical and mechanical contact with the conductive foil surrounding the insulative core of the cable. In this manner, electrical signals are prevented from traveling on the outer surface of the foil, but instead are forced to travel on the inner surface of the foil conductive layer.

In this alternative embodiment, the coaxial cable connector generally includes a connector body having a forward end and a rearward cable receiving end for receiving a cable and an annular post disposed within the connector body, wherein the post has an inner radial surface forming a central bore for receiving a foil covered dielectric portion of the coaxial cable. The central bore is defined by a first portion having a first inner diameter and a second portion having a second inner diameter, wherein the second inner diameter is smaller than the first inner diameter, whereby the inner radial surface forming the second portion of the central bore makes contact with the foil covered dielectric portion of the coaxial cable.

The first portion of the central bore is preferably disposed at a rearward end of the post adjacent the rearward cable receiving end of the connector body and the second portion of the central bore is disposed at a forward end of the post opposite the rearward cable receiving end of the connector body.

The inner surface of the post can be designed as a tapered surface, a broached surface or a knurled surface. The inner surface of the post can also include one or more protrusions, tree pans or steps to provide one or more areas of the inner surface having a reduced diameter for making contact with the cable foil.

Specifically, the inner radial surface forming the second portion of the central bore can be formed with a plurality of axial grooves defining a broach structure or a plurality of grooves defining a knurl structure. The inner radial surface forming the central bore can be tapered in an axial direction, wherein the diameter of the central bore gradually decreases in a rearward direction away from the rearward cable receiving end of the connector body.

The second portion of the central bore can be defined by a tree pan structure, wherein the tree pan structure has an inner radial surface stepped radially inward with respect to the first portion of the central bore and a ramped surface transitioning the inner radial surface with the first portion of the central bore. The ramped surface tapers radially outwardly in a rearward direction away from the rearward cable receiving end of the connector body, whereby the inner radial surface and the ramped surface meet at a sharp edge facing the rearward cable receiving end of the connector body.

The present disclosure further involves a method for shielding electrical signals traveling in a coaxial cable connector from interference. The method generally includes the step of using a coaxial cable connector to direct the electromagnetic field carrying the electrical signal to the inner surface of a conductive layer of a foil surrounding an insulative core of the cable, wherein the coaxial cable connector prevents the electrical signals from migrating to an outer surface of the conductive foil, and wherein the foil conductive layer serves as a contiguous gap-free shield to prevent the ingress of RFI.

In one embodiment, the method includes the steps of inserting an end of the cable into a rearward cable receiving end of a connector body of the connector, engaging the end of the cable with a rearward end of an annular post coupled to the connector body of the connector during the cable inserting step and axially moving an annular signal ring disposed in a forward end of a central bore of the annular post in a rearward direction, whereby a rearward end of the annular signal ring engages the conductive foil at the end of the cable. In this manner, the outer surface of the conductive foil of the cable is forced against an inner conductive surface of the post by the rearward end of the annular signal ring during the step of axially moving the annular signal ring.

In an alternative embodiment, the method includes the steps of forcing the outer surface of the conductive foil against an inner conductive surface of an annular post disposed in the connector, by using internal structure of the post. Specifically, the post has an inner radial surface forming a central bore for receiving a conductive foil covered dielectric portion of the coaxial cable, wherein the central bore is defined by a first portion having a first inner diameter and a second portion having a second inner diameter. The second inner diameter is smaller than the first inner diameter whereby the inner radial surface forming the second portion of the central bore makes contact with the foil covered dielectric portion of the coaxial cable.

A preferred form of the coaxial connector, as well as other embodiments, objects, features and advantages of this invention, will be apparent from the following detailed description of illustrative embodiments thereof, which is to be read in conjunction with the accompanying drawings

DETAILED DESCRIPTION OF THE PREFERRED EMBODIMENTS

Figures 1, 1A, 1B:
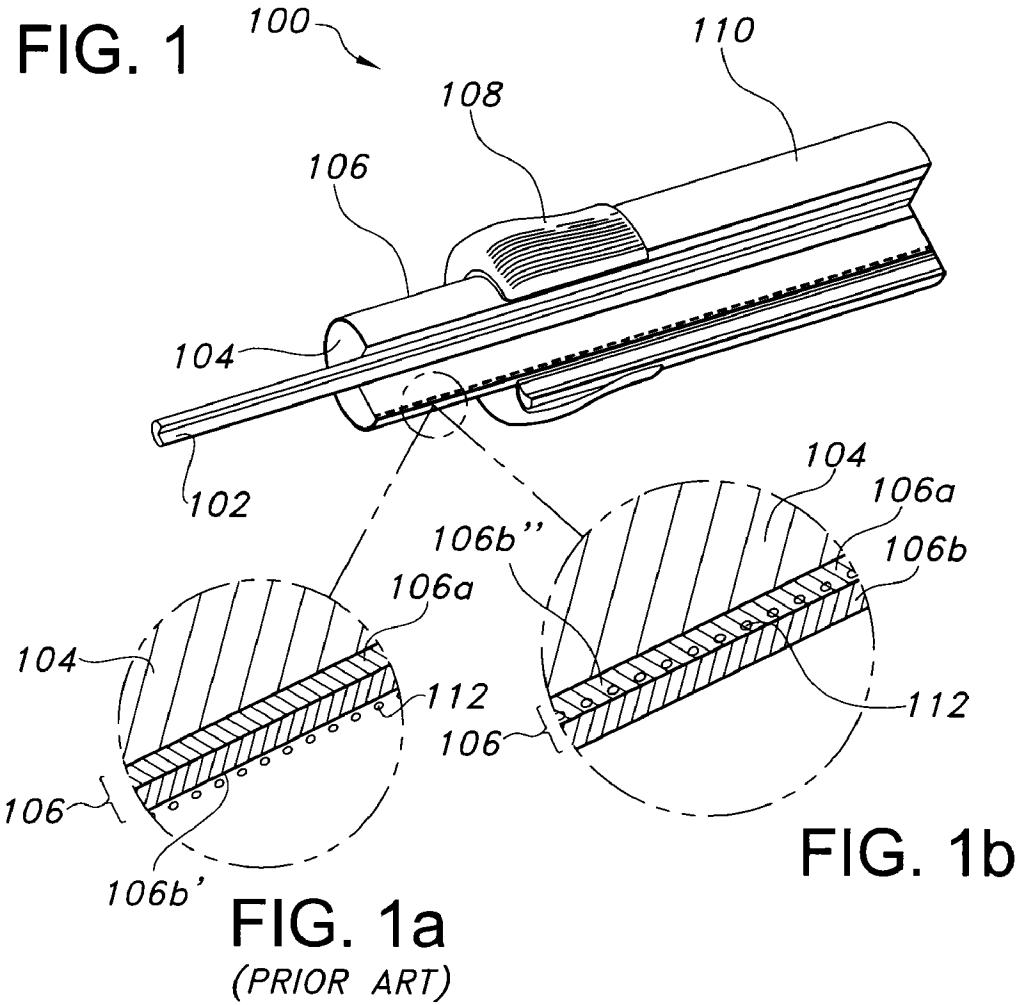
FIG. 1a (PRIOR ART)
FIG. 1 is a front perspective view of a prepared end of a coaxial cable.
FIG. 1*a* is an enlarged cross-sectional view of a portion of the cable shown in FIG. 1 showing the electrical signal flow according to the prior art.
FIG. 1*b* is an enlarged cross-sectional view of a portion of the cable shown in FIG. 1 showing the electrical signal flow as a result of the present invention.

Referring first to FIG. 1, a conventional coaxial cable 100 includes an inner conductor 102 formed of copper or similar conductive material. Surrounding the inner conductor 102 is an insulator 104 formed of a dielectric material, such as a suitably insulative plastic. A metallic foil 106 is disposed over the insulator 104 and a metallic braided shield 108 is positioned in surrounding relationship around the foil covered insulator. Covering the braided shield 108 is an outer insulative jacket 110.

As discussed above, the conductive foil 106 is typically a laminated structure including a Mylar, or other insulative layer 106*a* and a conductive layer 106*b*. The foil 106 is wrapped around the dielectric core 104 so that the Mylar layer 106*a* forms the inner surface of the foil in contact with the core 104 and the conductive layer 106*b* forms the outer surface of the foil. As discussed above, the design of conventional coaxial cable connectors results in a signal flow 112 on the outer surface 106*b*' of the conductive layer 106*b* of the foil 106, as shown in the prior art rendering of FIG. 1*a*.

As will be discussed in further detail below, the coaxial cable connector of the present invention results in a signal flow 112 on the inner surface 106*b*" of the conductive layer 106*b* of the foil, between the Mylar layer 106*a* and the conductive layer 106*b*, as shown diagrammatically in FIG. 1*b*. With the signal flow 112 provided on the inner surface 106*b*" of the conductive layer 106*b* of the foil 106, the conductive layer 106*b* will serve as a continuous RF shield for the signals, in addition to the braided shield 108. The result is a dramatic improvement in RF shielding.

Figure 2:
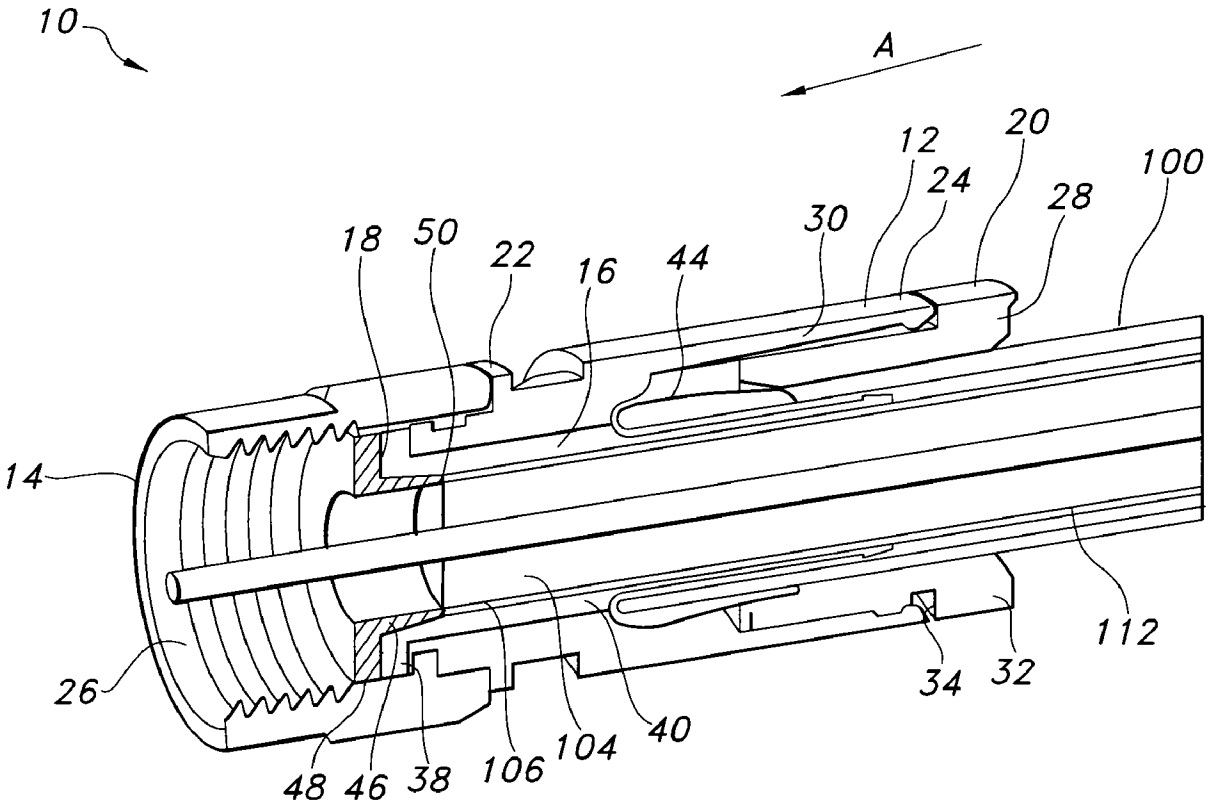
FIG. 2 is a front perspective cross-sectional view of a first embodiment of the coaxial cable connector of the present invention.
Figure 3:
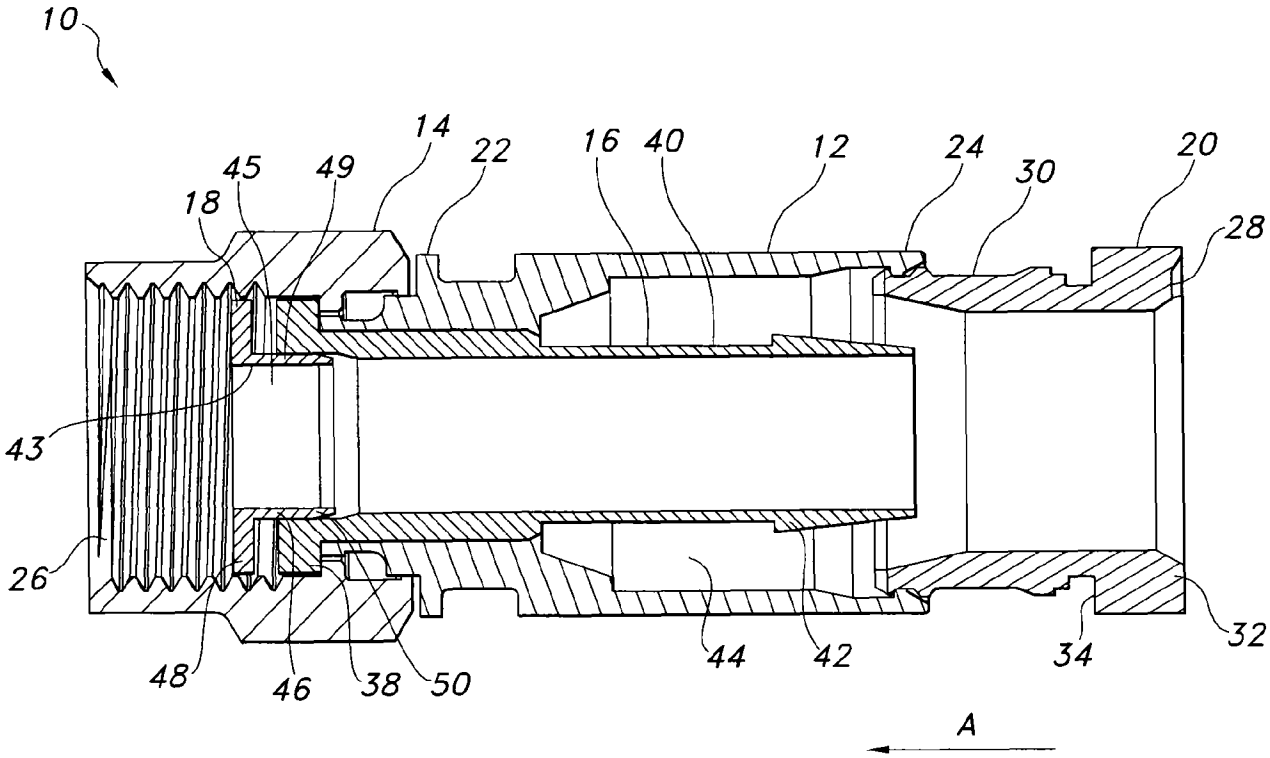
FIG. 3 is a cross-sectional view of the connector shown in FIG. 1 in an uncompressed condition.
Figure 4:
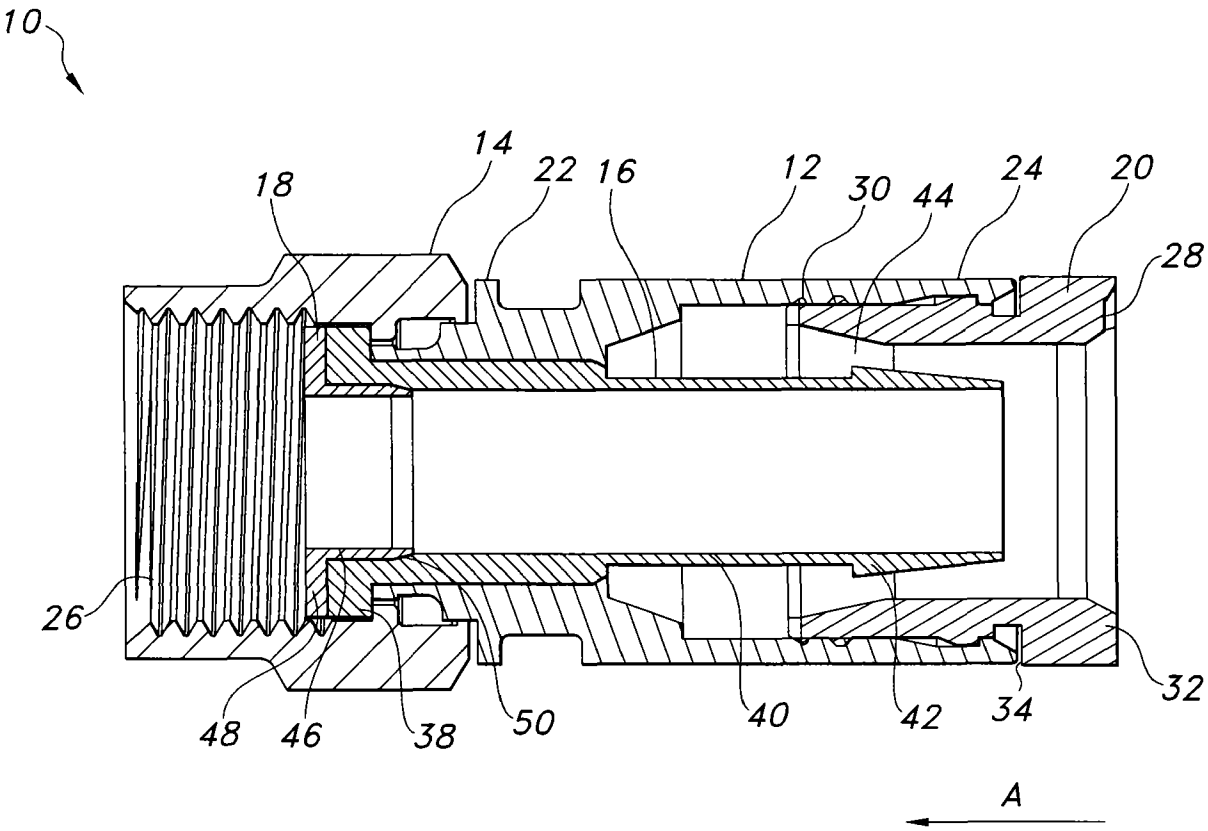
FIG. 4 is a cross-sectional view of the connector shown in FIG. 1 in a compressed condition.

Turning now to FIGS. 2-4, a first embodiment of the coaxial cable connector 10 of the present invention is shown. The connector 10 generally includes a connector body 12, a nut 14 rotatably connected to the connector body, an annular post 16 disposed within the connector body and an annular signal ring 18 disposed within the annular post. As will be discussed in further detail below, the connector 10 of the present invention further preferably includes a locking sleeve 20 movably coupled to the connector body 12.

The connector body 12, also called a collar, is an elongate generally cylindrical member, which can be made from plastic or from metal or the like. The body 12 has a forward end 22 coupled to the post 16 and the nut 14 and an opposite cable receiving end 24 for insertably receiving the locking sleeve 20, as well as a prepared end of a coaxial cable 100 in the forward direction as shown by arrow A in FIG. 2. The cable receiving end 24 of the connector body 12 defines an inner sleeve engagement surface for coupling with the locking sleeve 20. The inner engagement surface is preferably formed with detent structure, which cooperates with mating detent structure provided on the outer surface of the locking sleeve 20.

The locking sleeve 20 is a generally tubular member having a rearward cable receiving end 28 and an opposite forward connector insertion end 30, which is movably coupled to the inner surface of the connector body 12. As mentioned above, the outer cylindrical surface of the sleeve 20 includes a plurality of ridges or projections, which cooperate with the structure formed in the inner sleeve engagement surface of the connector body 12 to allow for the movable connection of the sleeve 20 to the connector body 12 such that the sleeve is lockingly axially moveable along arrow A toward the forward end 22 of the connector body from a first position, as shown in FIG. 3, which loosely retains the cable 100 within the connector 10, to a more forward second position, as shown in FIGS. 2 and 4, which secures the cable within the connector.

The locking sleeve 20 further preferably includes a flanged head portion 32 disposed at the rearward cable receiving end 28 thereof. The head portion 32 has an outer diameter larger than the inner diameter of the body 12 and includes a forward facing perpendicular wall 34, which serves as an abutment surface against which the rearward end of the body 12 stops to prevent further insertion of the sleeve 20 into the body 12. A resilient, sealing O-ring (not shown) is preferably provided at the forward facing perpendicular wall 34 to provide a water-tight seal between the locking sleeve 20 and the connector body 12 upon insertion of the locking sleeve within the body.

The connector 10 of the present invention further includes a nut 14 rotatably coupled to the forward end 22 of the connector body 12 so as to retain the connector body and the post 16 within the nut. The nut 14 includes an internally threaded surface 26 adapted for threaded connection with a mating externally threaded port terminal for providing mechanical attachment of the connector 10 to an external device. A resilient sealing O-ring (not shown) can be positioned in the nut 14 to provide a water resistant seal between the connector body 12, the post 16 and the nut 14.

The connector 10 of the present invention further includes an annular post 16 coupled to the forward end 22 of the connector body 12. The annular post 16 includes a flanged base portion 38 at its forward end for securing the post within the annular nut 14 and an annular tubular extension 40 extending rearwardly within the body 12 and terminating adjacent the rearward end 24 of the connector body 12. The rearward end of the tubular extension 40 preferably includes a radially outwardly extending ramped flange portion or "barb" 42 to enhance compression of the outer jacket of the coaxial cable to secure the cable within the connector 10. The tubular extension 40 of the post 16, the locking sleeve 20 and the body 12 define an annular chamber 44 for accommodating the jacket and shield of the inserted coaxial cable.

Disposed within the flanged base portion 38 at the forward end of the post 16 is the annular signal ring 18. The ring 18 is made from a metallic material, such as brass, and includes an inner radial surface 43 defining a central bore 45 extending the length of the ring. The ring 18 further includes a tubular body portion 46 and a radially enlarged head portion 48 disposed at a forward end of the body portion.

The body portion 46 has an outer diameter generally matching the inner diameter of the post 16 so as to permit a friction-fit or press-fit therebetween. In this case, the inner diameter of the central bore 45 of the ring 18 will be less than the inner diameter of the post 16 by an amount equal to the thickness of the ring body portion 46.

Alternatively, a radial recess or counter-bore 49 can be provided in the forward end of the post bore to receive the ring 18 in a press-fit relation. In this case, the radial depth of the recess 49 and the thickness of the ring body portion are chosen so that the inner diameter of the central bore 45 of the ring 18 is less than or equal to the inner diameter of the post 16, for reasons that will be described below.

The head portion 48 of the ring 18 has an outer diameter generally matching the outer diameter of the flanged base portion 38 of the post 16 so that both the ring and the post can be contained within the nut 14. The head portion 48 also serves as an insertion stop between the ring 18 and the post 16 to prevent further rearward insertion of the ring in the post bore, as will be discussed in further detail below.

The body portion 46 of the ring 18 preferably terminates at a sharp edge 50 at its rearward end opposite the head portion. The edge 50, the function of which will be discussed in further detail below, preferably tapers inwardly from the outer surface of the body portion 46 toward the inner surface to form a radially outwardly expanding ramp on the rearward end of the ring 18.

The connector 10 of the present invention can be provided with the body portion 46 of the ring 18 fully inserted in the post 16 prior to assembly with a cable, as shown in FIG. 4. Alternatively, the connector 10 can be provided with the body portion 46 of the ring 18 partially withdrawn from the post 16, as shown in FIG. 3. When provided in an initially, partially withdrawn position, the ring 18 can be subsequently driven rearward into the post 16 with a suitable compression tool (not shown) upon assembly of the connector 10 to a cable 100.

Upon assembly, a prepared end of a coaxial cable 100 is inserted through the rearward cable receiving end 28 of the sleeve ring 20 to engage the post 16 of the connector 10 in a conventional manner. As the cable 100 is initially inserted, the cable braid 108 and jacket 110 are separated from the foil 106 covering the insulator 104 by the sharp edge 42 of the annular post 16. At the same time, the dielectric core 104 with the surrounding foil 106 is received within the central bore of the post 16.

Once the cable 100 is fully inserted in the connector body 12, the locking sleeve 20 is moved axially forward in the direction of arrow A from the first position shown in FIG. 3 to the second position shown in FIG. 4. This may be accomplished with a suitable compression tool. As the sleeve 20 is moved axially forward, the inner surface of the sleeve provides compressive force on the cable jacket 110 against the barb 42 of the annular post 16.

To permit the insertion of the foil covered core into the annular post 16, the internal diameter of the post central bore is made slightly larger than the outer diameter of the foil covered core. However, this difference in diameters creates a clearance or a gap between the outer surface of the foil 106 and the inner surface of the annular post 16. With conventional coaxial cable connectors, the electrical signals are drawn to this clearance causing a signal flow on the outer surface of the foil 106, as described above.

The annular signal ring 18 of the present invention prevents the electrical signals from migrating to the outer surface of the foil 106, but instead directs the signals to the inner surface 106*b*" of the outer conductive layer 106*b* of the foil 106, as shown in FIG. 1*b*. Specifically, the annular signal ring 18 of the present invention acts as an electrical dam, which blocks access to the outer surface of the foil and directs the signals instead to the inner surface 106*b*" of the outer conductive layer 106*b* of the foil 106. This is accomplished in the following manner.

If the connector 10 has been provided with the ring 18 already fully inserted in the post 16, as shown in FIGS. 2 and 4, insertion of the cable 100 into the connector 10 will cause the foil 106 covering the dielectric 104 to come into contact with the rearward end of the ring 18. More specifically, since the inner diameter of the central bore 45 of the ring body portion 46 is slightly less than the inner diameter of the post 16, and therefore slightly less than the outer diameter of the cable foil 106 covering the cable insulator 104, the sharp edge 50 of the body portion 46 of the ring 18 will make mechanical and electrical contact with the outer conductive layer 106*b* of the foil 106 as the cable 100 is inserted into the post 16.

Figure 5:
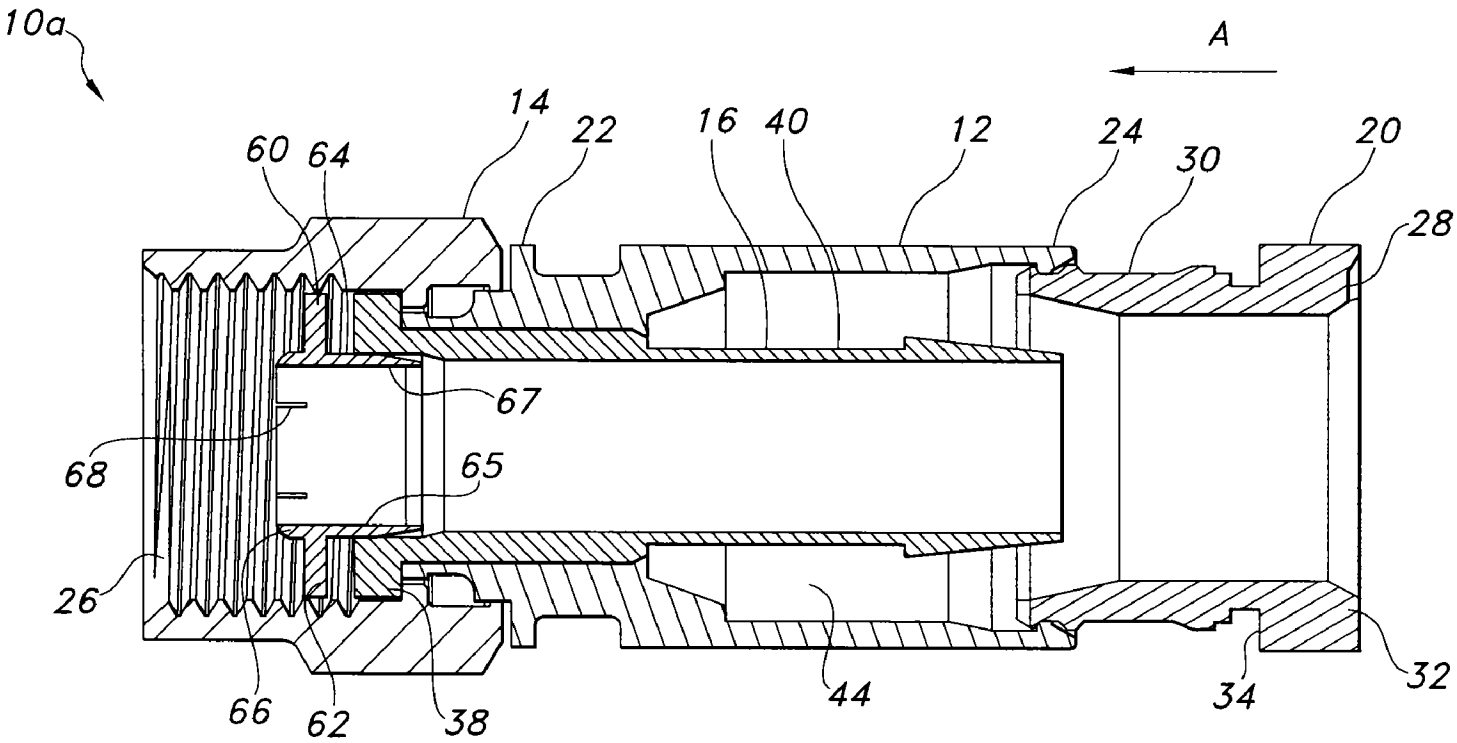
FIG. 5 is a cross-sectional view of the coaxial cable connector of the present invention in an uncompressed condition and showing an alternative embodiment of the annular signal ring.
Figure 6:
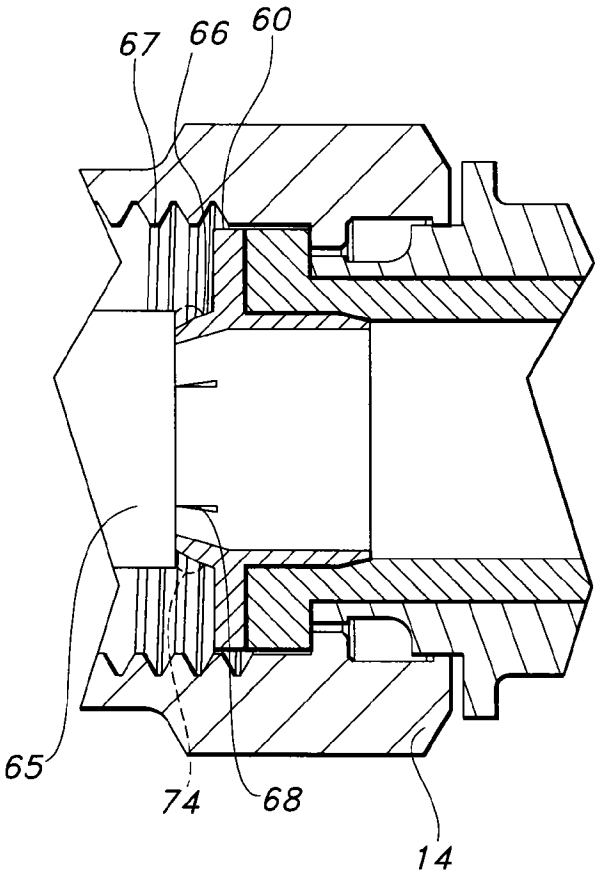
FIG. 6 is an enlarged cross-sectional view of the coaxial cable connector of the resent invention being attached to a terminal port.

Alternatively, in the embodiment where the connector 10 is provided with the ring 18 partially withdrawn from the post 16, as shown in FIGS. 3, 5 and 6, the ring is subsequently driven into the post after the cable 100 has been inserted. The result, however, is the same in that the sharp edge 50 of the body portion 46 of the ring will be driven into the foil 106 so that the ring 18 will come into mechanical and electrical contact with the outer conductive layer of the foil 106.

In both embodiments, the ring 18 thus provides a continuous path for the signal between the terminal port (not shown, but would be attached to the connector 10 via the nut 14) and the inner surface 106*b*" of the outer conductive layer 106*b* of the foil 106. The ring 18 further prevents the signal from entering the region between the outer surface 106*b*' of the foil 106 and the inner surface of the post 16.

In other words, electrical signals traveling from a terminal port (not shown) will first come in contact with the radially enlarged head portion 48 and commence to travel to the inner radial surface 43 of the ring bore 45 due to the skin effect discussed above. The signals will continue to travel to the sharp edge 50 of the tubular body portion 46 where they come into contact with the conductive layer 106*b* of the foil 106. Because the signals cannot penetrate through the conductive layer 106*b*, they will be forced to travel along the inner surface 106*b*" of the outer conductive layer 106*b* of the foil 106.

Thus, the ring 18 of the connector 10 according to the present invention provides a connection under the laminated foil 106 and over the center conductor dielectric 104 for superior signal flow. This improves performance of the braided over foil cable types, as used with 50 and 75-Ohm cables. The new method according to the present invention improves the cable to connector interface ground path by providing a shorter passageway, which reduces the effects of signal ingress and egress. The system also improves higher frequency performance.

The signal ring of the present invention can also be provided with additional structural features to improve connection between the connector 10 and an externally threaded terminal port. Thus, as shown in FIG. 5, the connector 10*a* includes an annular signal ring 60 having a radially enlarged head portion 62 and a tubular body portion 64 extending axially from the head portion in the rearward direction, as described above. However, in this embodiment, the annular signal ring 60 further includes a tubular tensioning sleeve 66 extending axially from the head portion in the forward direction opposite the tubular body portion.

Again, the body portion 64 has an outer diameter generally matching the inner diameter of the post 16 so as to permit a friction-fit or press-fit engagement therebetween and the head portion 62 of the ring 60 has an outer diameter generally matching the outer diameter of the flanged base portion 38 of the post 16 so that both the ring and the post can be contained within the nut 14. Also, the ring 60 again defines a central bore 65 having an inner diameter less than the inner diameter of the post 16 so that the sharp edge 67 of the ring will engage the foil 106 of the cable 100.

The tubular tensioning sleeve 66, however, is designed to maintain a short ground path connection between the connector 10*a* and a terminal port 65 (FIG. 6) as the nut 14 of the connector 10*a* is tightened on the terminal port. With conventional coaxial cable connectors, if the connector is not properly installed to the fully tightened position for full metal to metal contact between the male and female inter port, a gap may be formed, wherein the passing signals within the ground patch will be subject to ingress and egress issues. By providing the tensioning sleeve 66, the metallic signal ring 60 of the connector 10*a* of the present invention maintains a low value RF electrical inductance path between the male connector and female inter-port, even if the nut 14 of the connector is slightly loosened. As a result, the RF signal ground path integrity is preserved.

Specifically, as shown in FIG. 6, the tubular tensioning sleeve 66 is adapted to bend or flex radially inward as the ring 60 is axially compressed against a terminal port 65 during attachment of the connector to the port. As the sleeve 66 bends inward, a resilient biasing force is created at the forward end of the ring 60, which causes the sleeve to maintain contact with the terminal port 65 despite any slight axial movement therebetween.

To enhance flexibility in the axial direction, the tubular tensioning sleeve 66 is preferably provided with a plurality of radially arranged axial slots 68 extending rearward from the forward most end of the ring 60 to permit the forward most end of the ring to freely bend inwardly. Specifically, the slots 68 facilitate slight radial movement of the end of the sleeve 66 upon axial compression of the ring 60 so that mechanical and electrical contact will be maintained between the ring 60 and the terminal port upon tightening and loosening of the nut 14 on the external thread 67 of the port 65. Six slots 68 have been found to provide optimal electrical shielding performance in view of the cost to manufacture the ring 60.

Figure 7:
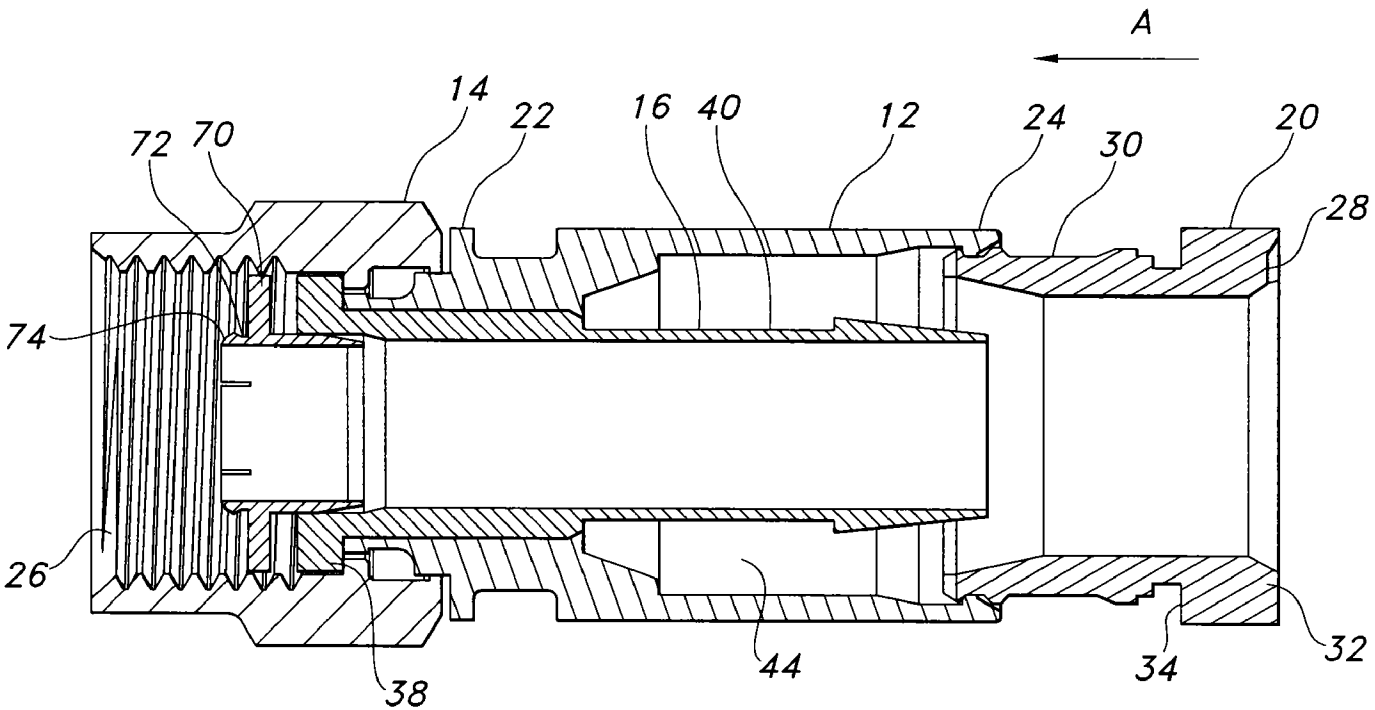
FIG. 7 is a cross-sectional view of the coaxial cable connector of the present invention in an uncompressed condition and showing another alternative embodiment of the annular signal ring.

FIG. 7 shows an alternative embodiment of an annular signal ring 70 having a slightly modified tubular tensioning sleeve 72. In this embodiment, the forward most end of the tensioning sleeve 72 has been rounded to form a bulbous rim 74 at the end of the sleeve. This rim 74 acts as a cam surface to facilitate inward radial movement of the sleeve 72 upon axial compression of the ring 70. (The bulbous rim 74 is shown in dashed lines in the enlarged view of FIG. 6.)

Operation of the alternative ring embodiments 60, 70 is the same as that described above with respect to the ring 18. In particular, as the cable 100 is fully inserted in the connector body 12, and the locking sleeve 20 is moved axially forward in the direction of arrow A, the sharp edge of the body portion of the ring 18, 60, 70 will be driven into the conductive layer 106*b* of the foil 106 so that the ring will provide a continuous signal path to and from the inner surface 106*b*" of the outer conductive layer 106*b* of the foil 106 and block access to the outer surface 106*b*' of the outer conductive layer 106*b* of the foil 106.

Direction of the signal to the inner surface 106*b*" of the outer conductive layer 106*b* of the foil 106 can also be achieved by providing structure integrally on the inner surface of the post to ensure that the outer conductive layer 106*b* of the foil 106 comes into direct contact with the post.

Figure 8B:
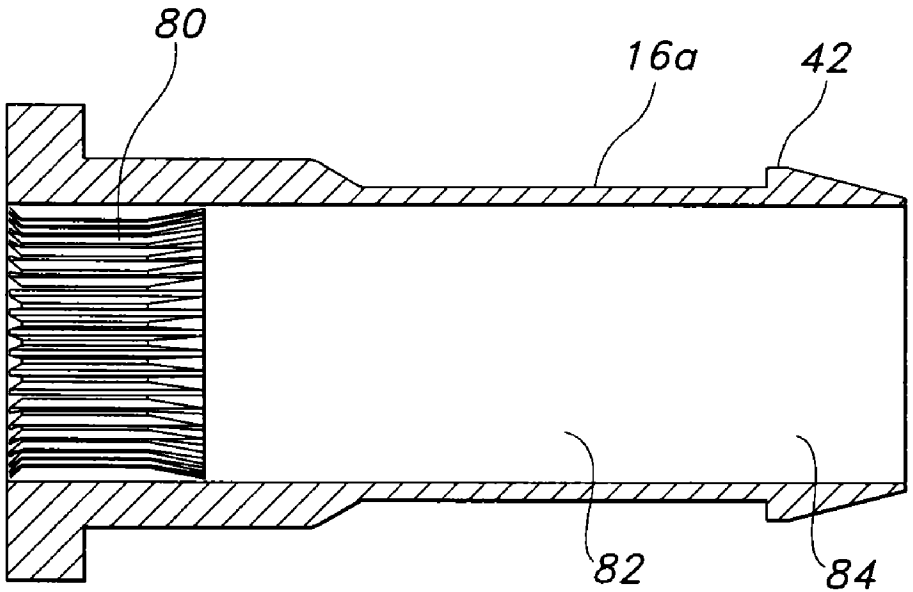
FIG. 8*b* is a cross-sectional view of the post shown in FIG. 8*a* taken along the line 8*b*-8*b*.
Figure 8A:
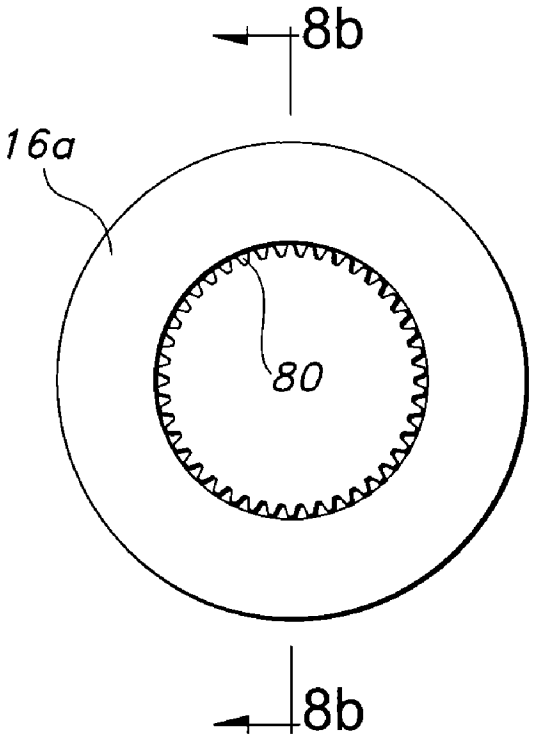
FIG. 8*a* is an end view of an alternative embodiment of the post according to the present invention.

Thus, a post 16*a* can be provided having a broach or knurl structure 80 formed on its inner radial surface 82, as shown in FIGS. 8*a* and 8*b*. The broach or knurl structure 80 is preferably formed at the forward end of the post bore opposite the post barb 42 and is generally defined by an arrangement of grooves formed in the surface of the bore. In this manner, the post bore is defined by a rearward portion 84 having an inner diameter slightly larger than the foil covered dielectric core, as described above, to permit insertion of the foil covered dielectric core into the post 16*a*, and a forward broach structure portion 80 having a reduced diameter, as compared with the rearward portion 84, for engaging the foil 106 as the cable is inserted into the connector.

Figure 9:
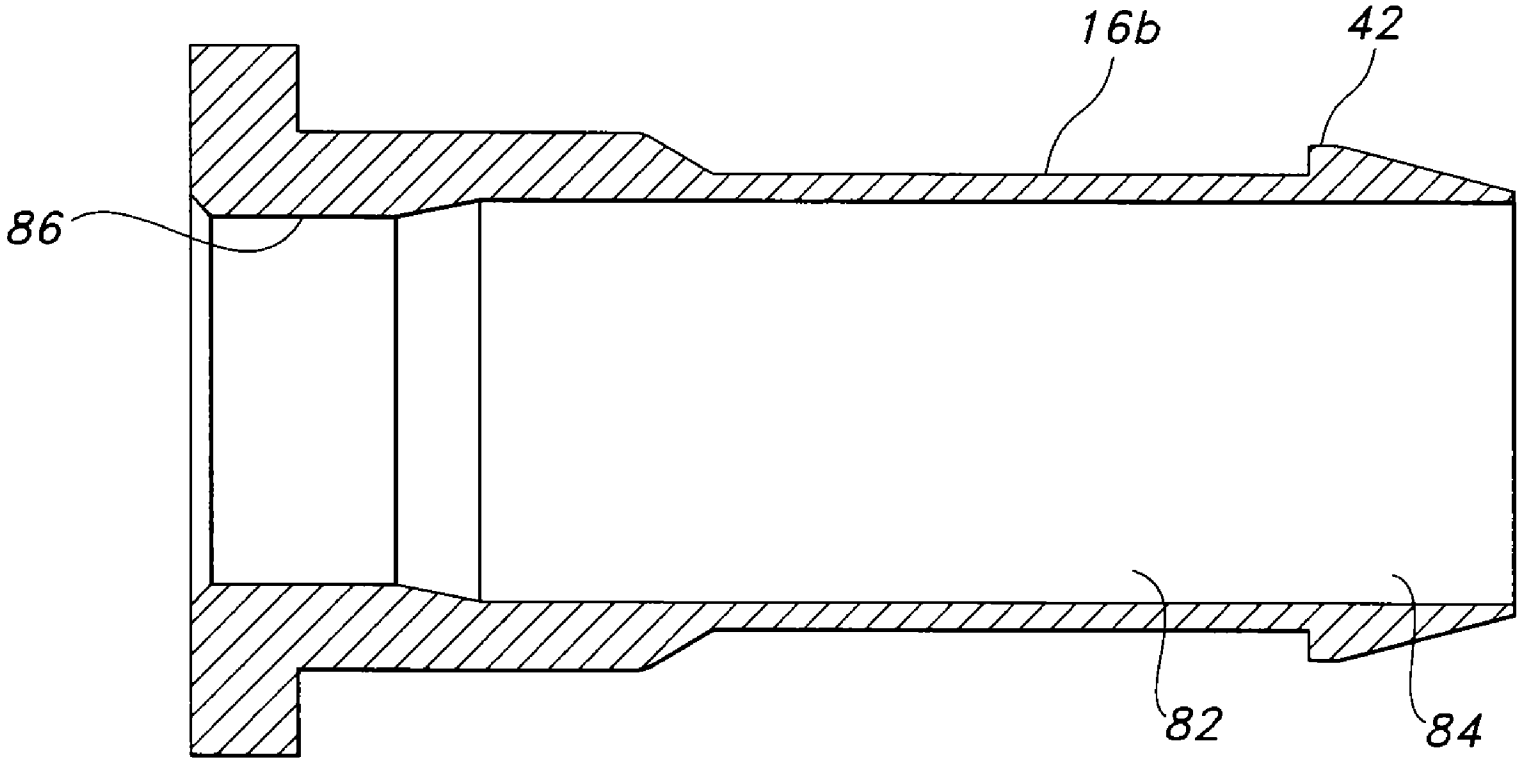
FIG. 9 is a cross-sectional view of another alternative embodiment of the post according to the present invention.

Alternatively, a post 16*b* can be provided having a protrusion or step 86 formed on its inner radial surface 82, as shown in FIG. 9. Similar to the broach or knurl structure 80 described above, the step 86 is preferably formed at the forward end of the post bore opposite the post barb 42. In this manner, the post bore is again defined by a rearward portion 84 having an inner diameter slightly larger than the foil covered dielectric core and a forward portion 86 having a reduced diameter, as compared with the rearward portion 84, for engaging the foil 106 as the cable is inserted into the connector.

Figure 10:
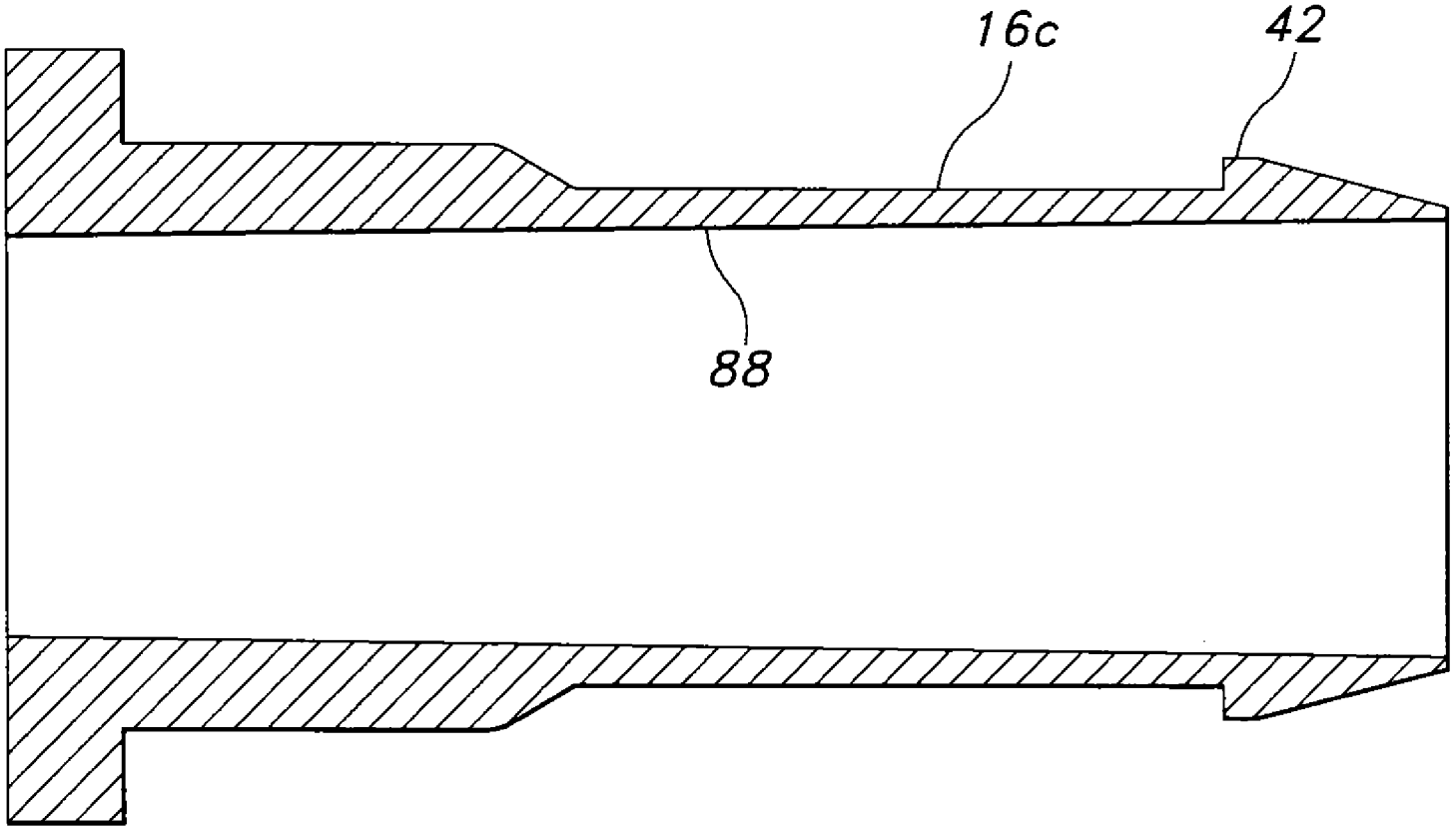
FIG. 10 is a cross-sectional view of still another alternative embodiment of the post according to the present invention.

FIG. 10 shows another alternative embodiment of a post 16*c*, which, in this case, has a tapered inner surface 88 defining the post bore. The tapered inner surface 88 has a diameter at its rearward end slightly larger than the foil covered dielectric core to permit insertion of the foil covered dielectric core into the post 16*a*. The diameter of the tapered inner surface 88 gradually decreases in the rearward direction away from the barb 42 so that the rearward portion of the post inner surface will engage the foil 106 as the cable is inserted into the connector.

Figure 11:
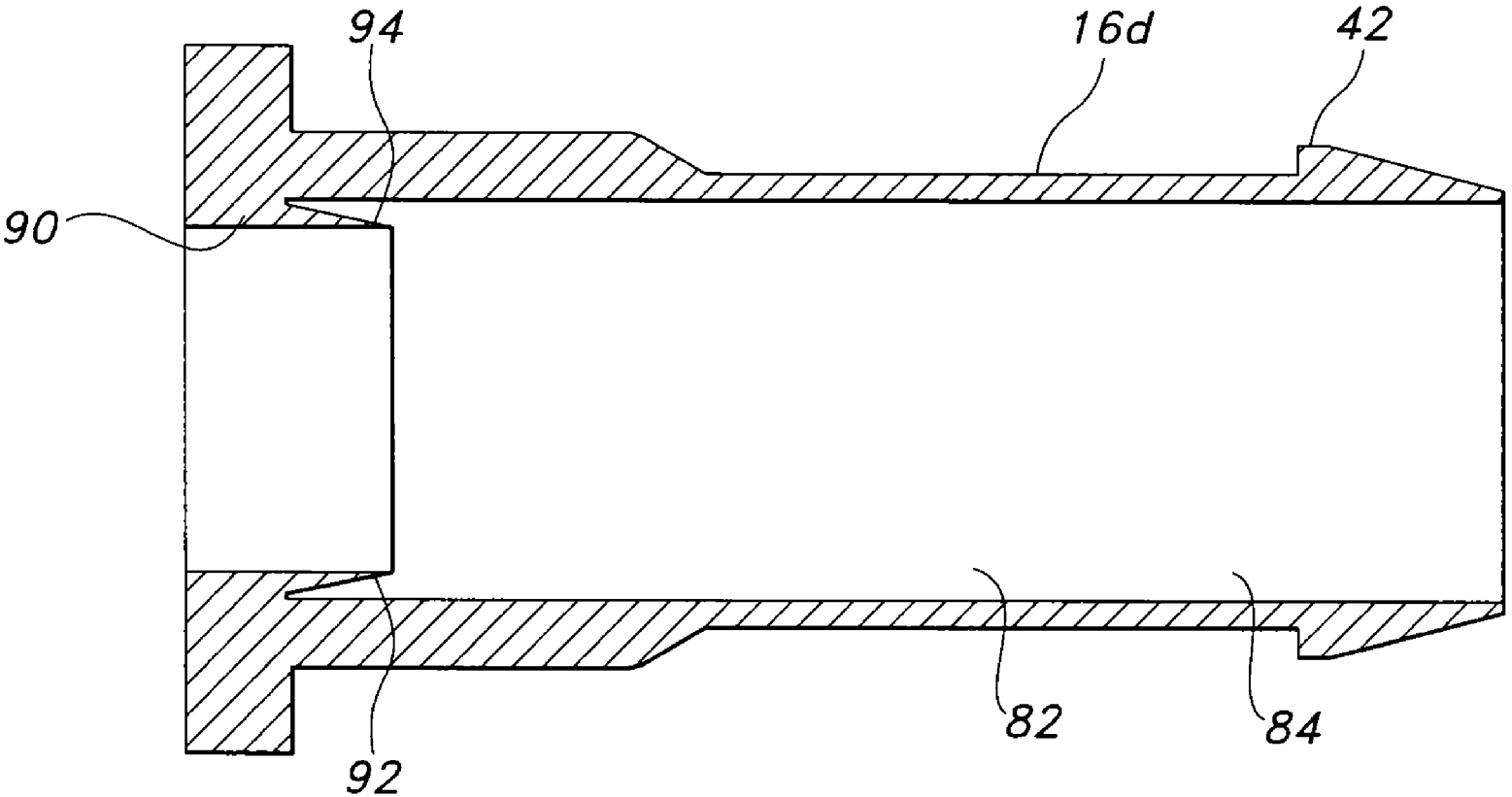
FIG. 11 is a cross-sectional view of yet another alternative embodiment of the post according to the present invention.

In yet another alternative embodiment, as shown in FIG. 11, a post 16*d* can be provided having a "tree pan" structure 90 formed on its inner radial surface 82. The tree pan structure 90 is similar to the step 86 described above, but instead of smoothly transitioning with the inner radial surface 82, as with the step 86 shown in FIG. 9, the reduced diameter portion of the bore defined by the tree pan structure 90 transitions with the inner radial surface 82 of the bore via a reverse cut or under cut 92. Again, the tree pan structure 90 is preferably formed at the forward end of the post bore opposite the post barb 42 to define a rearward portion 84 having an inner diameter slightly larger than the foil covered dielectric core and a forward portion having a reduced diameter, as compared with the rearward portion 84. However, due to the undercut transitioning the forward tree pan portion 90 with the rearward portion, the rearward end of the forward portion is formed with a sharp edge 94 for engaging the foil 106 as the cable 100 is inserted into the connector.

In each of the embodiments shown in FIGS. 8-11, the post includes an internal central bore formed with an area of reduced inner diameter for engaging the foil 106 of the cable 100. Once the outer conductive layer 106*b* of the foil 106 is in contact with the inner surface of the post 16, the signal flow path to the outer surface 106*b*' of the outer conductive layer 106*b* of the foil 106 is blocked. As a result, the electrical signals will instead migrate to the inner surface 106*b*" of the outer conductive layer 106*b* of the foil 106, wherein the outer conductive layer 106*b* will again serve as an RF shield for the signals.

As a result of the present invention, the new interface provides numerous enhancements including: improved interface shielding (signal egress and ingress); reduced micro-reflections; reduced effects of passive intermodulation distortion; higher frequency bandwidth performance; and improved shielding performance allowing the use of lower percentage shielded cable types resulting in a cost savings related to replacing existing cables in obtaining better system performance.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector for coupling a coaxial cable to a mating connector comprising:

a connector body having a forward end and a rearward cable receiving end for receiving a cable; and an annular post disposed within said connector body, said post having an inner radial surface forming a central bore for receiving a foil covered dielectric portion of the coaxial cable, said central bore being defined by a first portion having a first inner diameter and a second portion having a second inner diameter, said second inner diameter being smaller than said first inner diameter whereby said inner radial surface forming said second portion of said central bore makes contact with the foil covered dielectric portion of the coaxial cable.

2. A coaxial cable connector as defined in claim 1, wherein said first portion of said central bore is disposed at a rearward end of said post adjacent said rearward cable receiving end of said connector body and said second portion of said central bore is disposed at a forward end of said post opposite said rearward cable receiving end of said connector body.

3. A coaxial cable connector as defined in claim 1, wherein said inner radial surface forming said second portion of said central bore comprises a plurality of axial grooves formed therein defining a broach structure.

4. A coaxial cable connector as defined in claim 1, wherein said inner radial surface forming said second portion of said central bore comprises a plurality of grooves formed therein defining a knurl structure.

5. A coaxial cable connector as defined in claim 1, wherein said inner radial surface forming said central bore is tapered in an axial direction, wherein the diameter of said central bore gradually decreases in a rearward direction away from said rearward cable receiving end of said connector body.

6. A coaxial cable connector as defined in claim 1, wherein said second portion of said central bore is defined by a tree pan structure, said tree pan structure comprising an inner radial surface stepped radially inward with respect to said first portion of said central bore and a ramped surface transitioning sad inner radial surface with said first portion of said central bore, said ramped surface tapering radially outwardly in a rearward direction away from said rearward cable receiving end of said connector body, whereby said inner radial surface and said ramped surface meet at a sharp edge facing said rearward cable receiving end of said connector body.

* * * * *